US008444313B2

(12) United States Patent
Yang et al.

(10) Patent No.: US 8,444,313 B2
(45) Date of Patent: May 21, 2013

(54) ATTACHABLE TIMEPIECE

(76) Inventors: Eric Yang, Fountain Valley, CA (US); Meghan Yang, Fountain Valley, CA (US)

( * ) Notice: Subject to any disclaimer, the term of this patent is extended or adjusted under 35 U.S.C. 154(b) by 189 days.

(21) Appl. No.: 13/040,165

(22) Filed: Mar. 3, 2011

(65) Prior Publication Data

US 2012/0224461 A1 Sep. 6, 2012

(51) Int. Cl.
*G04B 37/00* (2006.01)

(52) U.S. Cl.
USPC ..... 368/301; 368/310; 368/291

(58) Field of Classification Search
USPC ..... 368/276, 301–305, 309–310, 297–298, 368/319, 291–292; 224/180
See application file for complete search history.

(56) References Cited

U.S. PATENT DOCUMENTS 225,874 A * 3/1880 Rossetti ..... 368/303
1,004,968 A * 10/1911 Baugh ..... 224/614
2,035,965 A * 3/1936 Houghtaling ..... 24/265 B
4,194,354 A * 3/1980 Terraillon ..... 368/276
4,267,615 A 5/1981 Nealy
5,127,860 A 7/1992 Kraft
5,127,861 A 7/1992 Ross
5,290,195 A 3/1994 Prickett
5,540,367 A * 7/1996 Kauker ..... 224/269
5,598,383 A * 1/1997 Li ..... 368/291
5,779,113 A * 7/1998 Huang ..... 224/172
6,164,814 A * 12/2000 Crow ..... 368/276
6,519,207 B1 * 2/2003 Lukacsko ..... 368/10
6,619,835 B2 * 9/2003 Kita ..... 368/281
2009/0258552 A1 10/2009 Wardle

* cited by examiner

*Primary Examiner* — Sean Kayes

(74) *Attorney, Agent, or Firm* — Sheppard Mullin Richter & Hampton LLP

(57) ABSTRACT

One embodiment of the present invention provides an attachable timepiece, comprising: an upper chamber forming a housing for timepiece elements, the upper chamber including a front face having a time display; a lower chamber that is detachable from the upper chamber by way of a locking system; and a means for attaching the timepiece to an object.

14 Claims, 7 Drawing Sheets

ATTACHABLE TIMEPIECE

TECHNICAL FIELD

The present invention relates generally to an attachable timepiece, and more particularly, to an attachable timepiece for surfers.

DESCRIPTION OF THE RELATED ART

When surfers surf, they are inextricably are tied to time. This holds true whether it is before work, during lunch, before an appointment/meeting, or just trying to not get a parking ticket from the expiring meter.

One may ask, "well, don't surfers wear watches?!" The answer is a resounding "NO!" Most surfers will tell you that from their experience in the water, one simply cannot find the time from anyone! Even in the busiest surf spots, e.g., in Southern California, it is almost impossible to get the time from a fellow surfer.

The reason why most surfers do not wear watches is due to the fact that it restricts wrist movement while paddling and popping up. Additionally, watches are know to be cumbersome, annoying, difficult to wear with a wetsuit, and uncomfortable. Furthermore, most sporting watches such as G-Shock, Freestyle and Quiksilver are bulky and oversized.

In view of the above, there exists a need for a practical timepiece for surfers that does not suffer from the known drawbacks set forth above.

BRIEF SUMMARY OF EMBODIMENTS OF THE INVENTION

Embodiments of the present invention provide attachable timepieces for various activities such as surfing.

One particular embodiment provides an attachable timepiece, comprising: an upper chamber forming a housing for timepiece elements, the upper chamber including a front face having a time display; a lower chamber that is detachable from the upper chamber by way of a locking system; and a means for attaching the timepiece to an object. The means for attaching may comprise a looped string that is attached to the lower chamber. The lower chamber is hollow and includes a centrally disposed aperture for the passage of the looped string prior to being knotted within the lower chamber, thereby connecting the looped string to the lower chamber In some configurations, the front face of the timepiece is substantially flat and the time display comprises a digital time display. In addition, the locking system may comprise a threaded section disposed on an outside portion of the upper chamber that is configured to mate with a corresponding threaded section disposed on an inside portion of the lower chamber. The upper chamber is detached from the lower chamber by unscrewing the upper chamber from the lower chamber. In some embodiments, the upper chamber makes an audible snap when fully screwed onto the lower chamber indicating that the chambers are in locking engagement.

According to certain embodiments, the timepiece is configured to be attached to a surfboard leash plug, wherein the looped string is threaded through the surfboard leash plug and pulled until the lower chamber is forced against the plug. In such embodiments, the lower chamber is configured to engage the surfboard leash plug such that the front face remains visible to the user. The looped string provides a means for user to attach a surfboard leash.

According to other embodiments, the timepiece is attached to an object that is selected from the group consisting of a paddle board, a wake board, a ski, a snowboard, wind surfing gear, kite boarding gear, hiking gear, tennis gear, swimming gear, diving gear, fishing gear, golfing gear, and basketball gear.

Further embodiments of the invention are directed toward an attachable timepiece, comprising: an upper chamber forming a housing for timepiece elements, the upper chamber including a front face having a digital time display and a threaded section; a lower chamber having a threaded section corresponding to the threaded section of the upper chamber such that the chambers are configured to be screwed together; and a looped string that is attached to the lower chamber, wherein the looped string is used to releasably attach a surfboard to a surfboard leash.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

The figures are not intended to be exhaustive or to limit the invention to the precise fog in disclosed. It should be understood that the invention can be practiced with modification and alteration, and that the invention be limited only by the claims and the equivalents thereof.

DETAILED DESCRIPTION OF THE EMBODIMENTS OF HE INVENTION

The present invention is directed toward a waterproof and impact-resistant timepiece for surfers that connects to a surfboard. More particularly, some embodiments of the invention are directed toward a timepiece that connects to a surfboard's "plug," thereby becoming the leashes "string tether." As used herein, the term "plug" describes a mounting means on a surfboard for connecting the leash and/or timepiece to the board. Additionally, as set forth herein, the term "string tether" describes a string, rope, cord or other attachment means for connecting connects the leash to the plug. The timepiece of the invention is readily detachable such that it can be interchanged between surfboards.

According to further embodiments of the invention, the attachable timepiece can be used for many other activities than just surfing. The attachable timepiece is particularly useful during those activities wherein it is beneficial to have one's wrists free from encumbrances such that full motion of the wrist is possible. By way of example, such activities include, but are not limited to, rock climbing, paddle boarding, wake boarding, skiing, snowboarding, wind surfing, kite boarding, hiking, tennis, swimming laps, diving, fishing, golfing, and basketball, and many other activities. Because the timepiece of the invention includes a string loop, it can be connected to almost any object, including without limitation, belt loops, belts, jackets, shoes, etc.

Figure 1A:
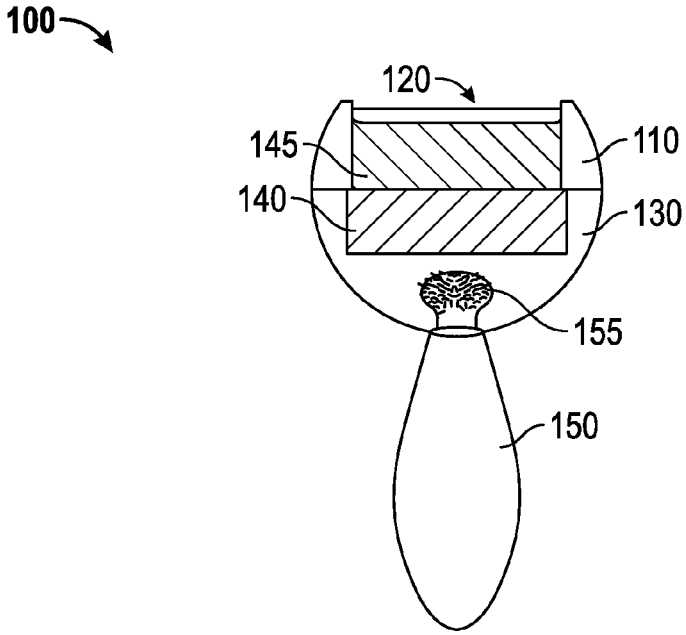
FIGS. 1A-1D are cross-sectional, top, upper chamber perspective, and lower chamber perspective views, respectively, of an attachable timepiece in accordance with the principles of the invention.

FIG. 1A is a cross-sectional view illustrating an attachable timepiece 100 in accordance with the principles of the invention. As depicted, the timepiece 100 comprises a spherical shape with the exception of the front face 120, which is a substantially flat surface. The substantially spherical shape gives the timepiece 100 sufficient strength to resist most impacts, and results in a product without sharp edges. As would be appreciated by those of skill in the art, many other timepiece shapes may be employed without departing from the scope of the invention. More particularly, the attachable timepiece 100 comprises an upper chamber 110 (including front face 120) that is detachable from a lower chamber 130 via a locking system 140. The attachable timepiece 100 further comprises a means 150 for attaching the timepiece 100 to an object such as the plug of a surfboard. As depicted, this means for attachment may comprise a looped string 150 that is tied into a knot 155 inside the lower chamber 130 of the timepiece 100.

Figure 1B:
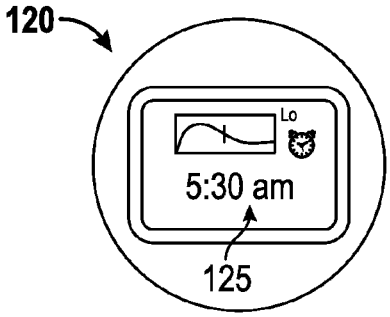

FIG. 1B is a top view of the attachable timepiece 100 illustrating its front face 120 including a digital time display 125. Alternatively, the front face 120 may feature a different time display such as a traditional analogue display face having Roman numerals, an hour hand and a minute hand. In further embodiments, the front face 120 may include additional conventional features such as displaying the current date, a tide gauge, alarms, stopwatch features, etc. Such conventional features are well known in the art.

Figure 1C:
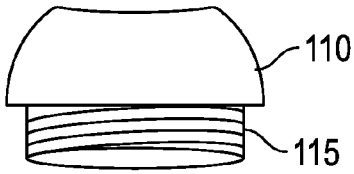
Figure 1D:
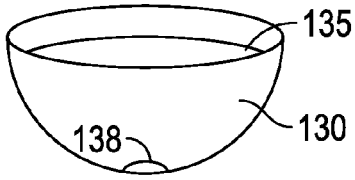

As stated, the timepiece 100 comprises two separate pieces or chambers 110, 130 attached via locking system 140. In the illustrated embodiment, the locking system 140 comprises a threaded section 115 disposed on the outside of upper chamber 110 that is configured to mate with a corresponding threaded section 135 disposed on the inside of lower chamber 130. Specifically, the two chambers 110, 130 can be detached by unscrewing the upper chamber 110 from the lower chamber 130, as illustrated in FIGS. 1C and 1D. In some embodiments, the locking system 140 is similar to that of a medicine bottle, i.e., the cap (upper chamber) makes an audible snap when fully screwed onto the bottle (lower chamber) so that it does not come undone during use. A rubber gasket may be employed to provide a tight seal between the chambers 110, 130, thereby ensuring the timepiece remains waterproof.

As depicted, the lower chamber 130 is hollow and includes a centrally disposed aperture 138 for the passage of the looped string 150 prior to being knotted within the lower chamber 130. The upper chamber 110 comprises the casing for housing the timepiece elements 145, which may include the display, battery, and other conventional timepiece elements, per se known in the art. The ability to unscrew the chambers 110, 130 allows the user to access the battery or other conventional timepiece elements for maintenance or replacement. The chambers 110, 130 may be formed of any suitable material such as a light metal or a hard plastic. In addition, the outside surface of the chambers 110, 130 may be provided with a suitable coating such as a thin rubber coating in order to enhance durability and water resistance.

Figure 2A:
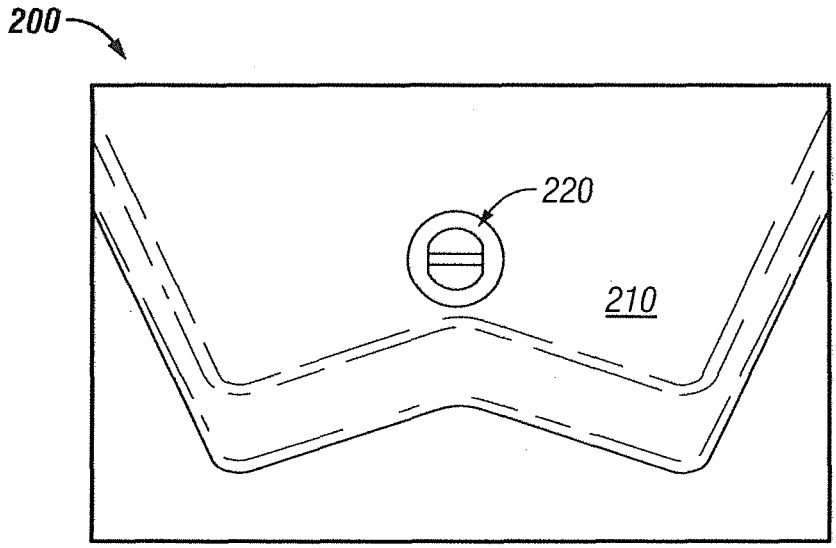
FIG. 2A is a perspective view showing a surfboard with a tail end having a conventional leash plug for attaching a leash to the surfboard.

FIG. 2A illustrates a surfboard 200 with a tail end 210 having a conventional leash plug 220 for attaching a leash to the surfboard 200. This conventional leash plug 220 a standard feature of virtually all surfboards.

Figure 2B:
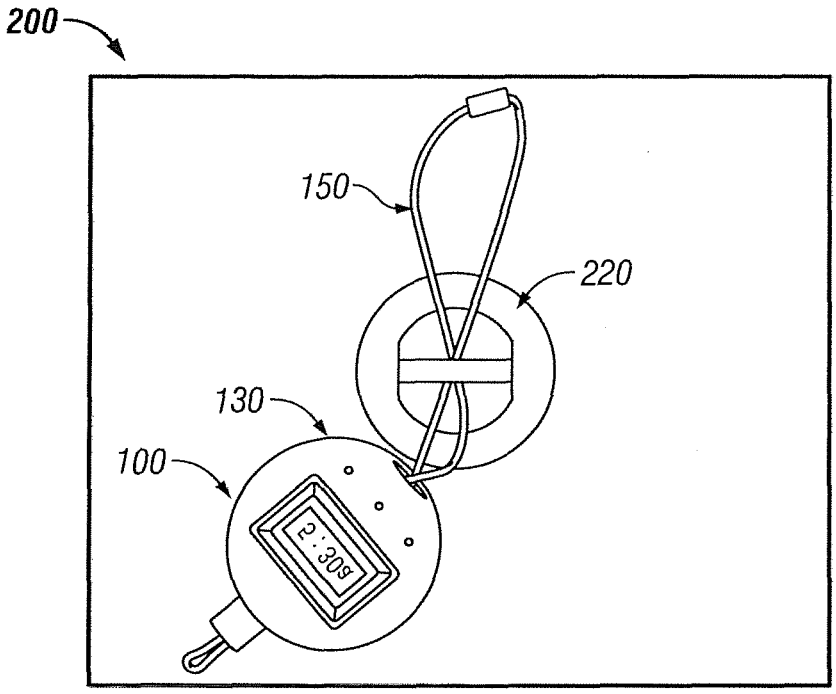
FIG. 2B is a perspective view showing the timepiece being attached to the leash plug.

FIG. 2B illustrates the looped string 150 being looped through the plug 220 and pulled until it is taut, such that the looped string 150 can now take the place of a conventional surfboard leash string. In other words, the looped string 150 is threaded through the plug 220 such that when the string 150 is pulled, the timepiece 100 is forced against the plug 220. However, since the timepiece 100 is larger that the plug 220, it remains in place adjacent the plug 220. Because the timepiece 100 is one-sided (i.e., only the front face 120 is flat), this allows the rounded lower chamber 130 to enter and hug the base of the plug 220. This prevents the timepiece 100 from whipping or leveraging against the surfboard 200 during use, thereby preventing damage to the surfboard 200.

Figure 2C:
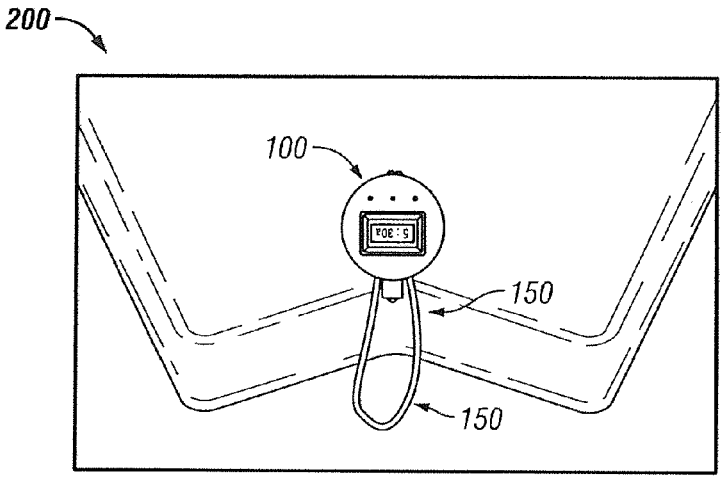
FIG. 2C is a perspective view illustrating the timepiece secured to the plug.

FIG. 2C illustrates the timepiece 100 in place, secured against the plug 220, and ready for a conventional surfboard leash to be connected to the looped string 150. During use, the substantially spherical shape of the timepiece 100 provides sufficient strength to resist most impacts. This design also results in a product without sharp edges to one's foot or ding one's board.

Figure 3:
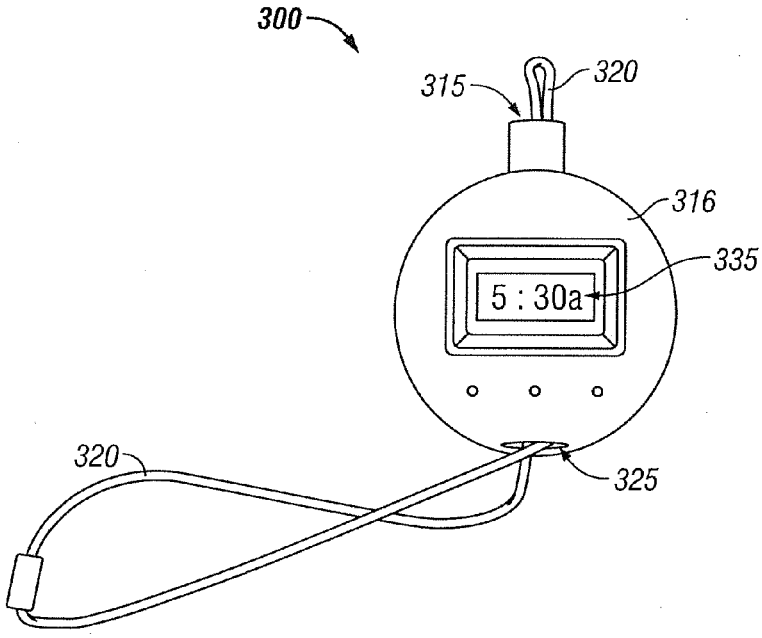
FIG. 3 is a front view illustrating an alternative attachable timepiece in accordance with the principles of the invention.

FIG. 3 depicts an alternative embodiment of the invention wherein timepiece 300 is similar in some ways to the timepiece 100 of FIG. 1. However, unlike timepiece 100, timepiece 300 comprises a substantially hollow sphere 310 having a top aperture 315 and a bottom aperture 325 allowing the looped string 320 to be fed through the timepiece 300 via apertures 315, 325. Similar to the previous embodiment, the timepiece 300 includes a digital time display 335. A knot 340 may be tied in the string 320 such that it cannot pass through aperture 325, thus allowing the timepiece to be attached to a conventional plug 220 as set forth above with respect to FIG. 2.

Figure 4A:
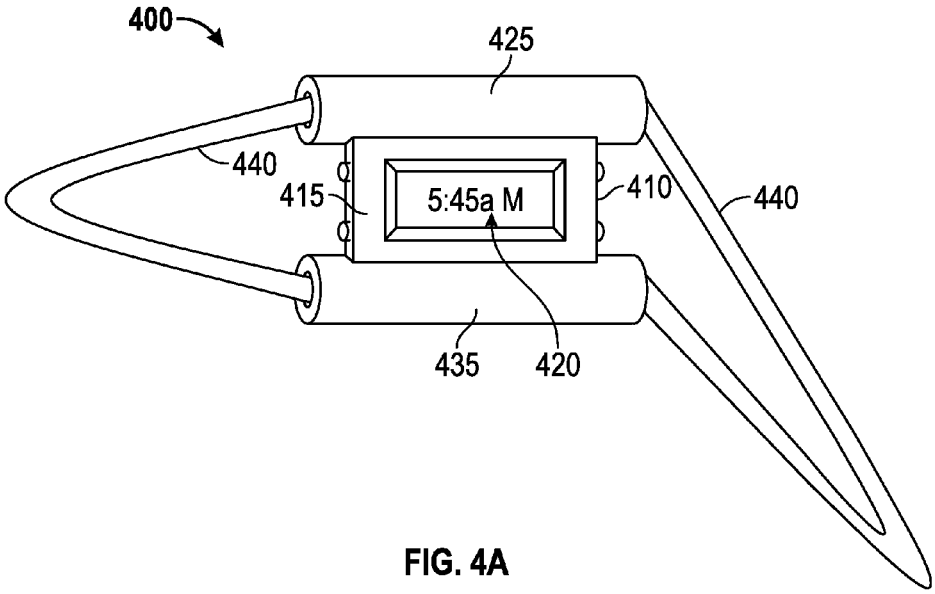
FIGS. 4A and 4B are front and cross-sectional views, respectively, illustrating another alternative attachable timepiece in accordance with the principles of the invention.
Figure 4B:
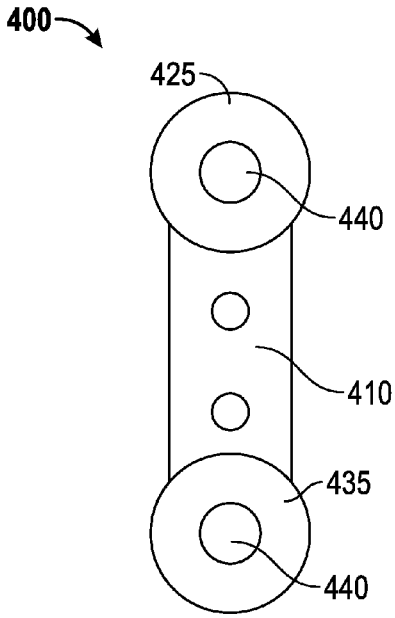

FIGS. 4A and 4B illustrate another alternative embodiment of the invention wherein timepiece 400 is similar in some ways to the previously described timepieces. As depicted, timepiece 400 comprises a substantially rectilinear portion 410 having a front face 415 including a digital time display 420. The timepiece further comprises a top cylinder 425 attached a the top of portion 410 and a bottom cylinder 435 attached to the bottom of portion 410. In this embodiment, looped string 440 is threaded through the cylinders 415, 425 and once end of the looped string 440 is pulled through and attached to a conventional plug 220, as set forth above with respect to FIG. 2.

Figure 5A:
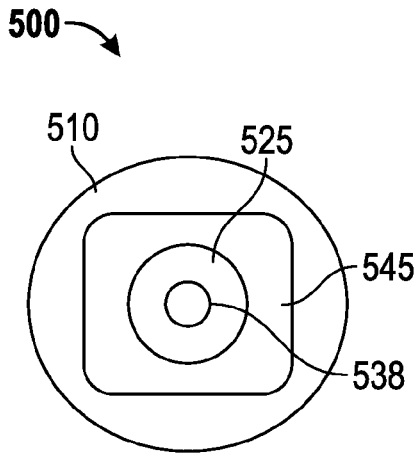
FIGS. 5A and 5B are top and cross-sectional views, respectively, illustrating a substantially solid timepiece in accordance with the principles of the invention.
Figure 5B:
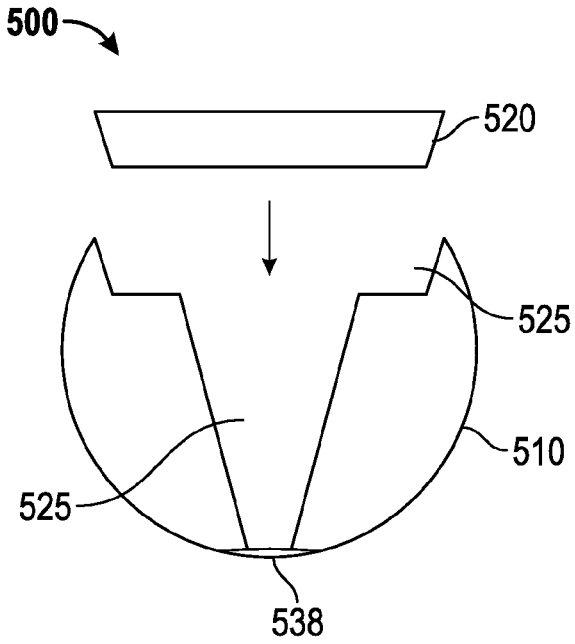

FIGS. 5A and 5B illustrate an attachable timepiece 500 comprising a substantially solid piece in accordance with the principles of the invention. In particular, the timepiece 500 comprises a semi-circular one-piece casing 510 that mates with a substantially flat front face 520. As set forth above, other timepiece shapes are possible without departing from the scope of the invention. The front face 520 is detachable from the casing 510 via a locking system 540. The attachable timepiece 500 further comprises a means for attaching the timepiece 100 to an object such as the plug of a surfboard. Similar to previous embodiments, the means for attachment may comprise a looped string that is tied into a knot inside a hollow portion 525 of the casing 510 such that the looped string passes through centrally disposed aperture 538 at the bottom of casing 510.

In the illustrated embodiment, the hollow portion 525 is cone-shaped to facilitate the knot being wedged securely within the hollow portion 525 when the string is pulled taut. The front face (or watch movement) 520 is dropped into a corresponding recess 545 in the casing 510 and attached via the locking system 540. The locking system 540 may comprise a threaded section 515 disposed on the outer perimeter of front face 520 that is configured to mate with a corresponding threaded section 535 disposed within recess 545. In some embodiments, the locking system 540 is similar to that of a medicine bottle, i.e., the cap (front face) makes an audible snap when fully screwed onto the bottle (casing) so that it does not come undone during use. A rubber gasket may be employed to provide a tight seal, thereby ensuring the timepiece remains waterproof. The watch battery may be accessed by removing the front face 520.

Figure 6A:
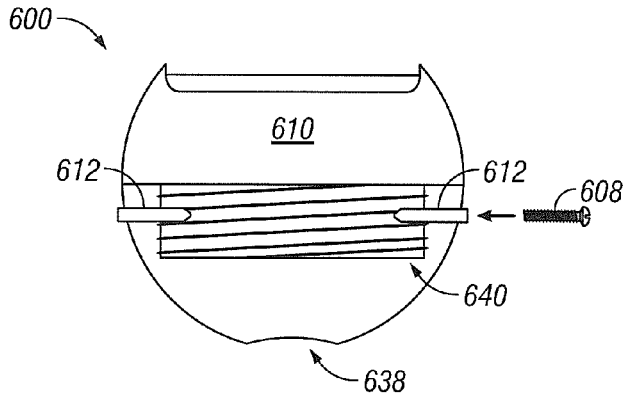
FIGS. 6A-6C are cross-sectional, top chamber and bottom chamber views, respectively, illustrating an attachable timepiece having an additional locking mechanism in accordance with the principles of the invention.
Figure 6B:
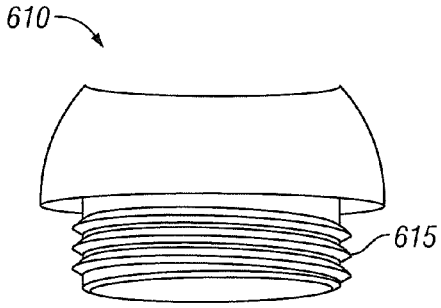
Figure 6C:
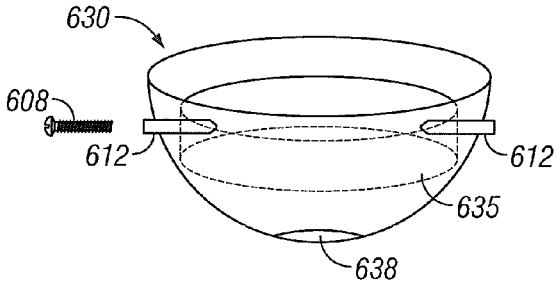

FIGS. 6A-6C illustrate an attachable timepiece 600 having an additional locking mechanism in accordance with the principles of the invention. The timepiece 600 is similar to the timepiece of FIGS. 1A and 1B with the exception of the additional locking mechanism, which may comprise one or more screws 608 configured to pass through corresponding apertures 612 in the upper and lower chambers 610, 630. In the illustrated embodiment, the locking system 640 comprises a threaded section 615 disposed on the outside of upper chamber 610 that is configured to mate with a corresponding threaded section 635 disposed on the inside of lower chamber 630. In addition, the locking system 640 further comprises screws 608, which are inserted into the apertures 612 to provide further assurance that the chambers 610, 630 will not detach during use. The lower chamber 630 includes a centrally disposed aperture 638 for the passage of the looped string.

Figure 7A:
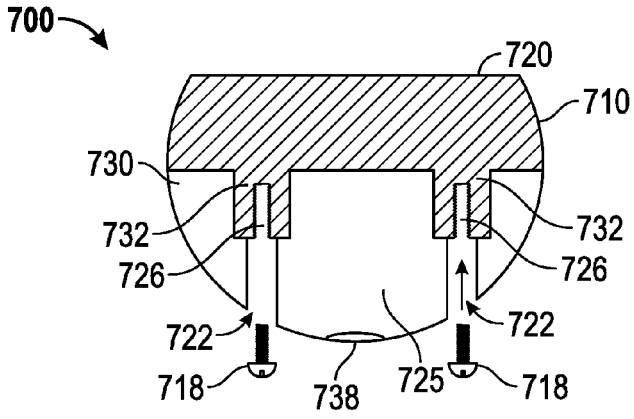
FIGS. 7A-7C are cross-sectional, top chamber and bottom chamber views, respectively, illustrating an attachable timepiece having an alternative locking mechanism in accordance with the principles of the invention.
Figure 7B:
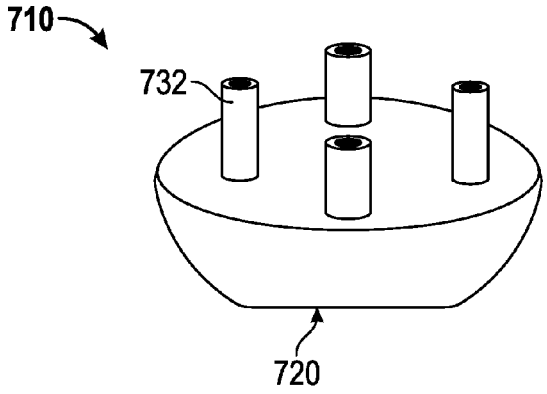
Figure 7C:
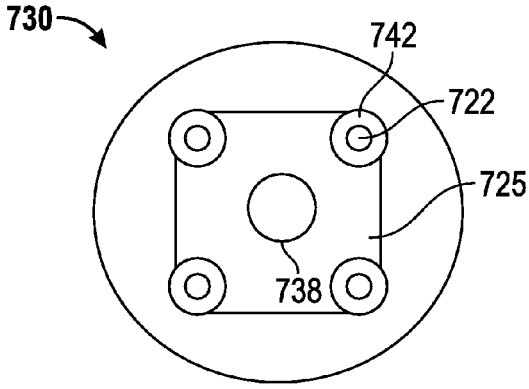

FIGS. 7A-7C illustrate an attachable timepiece 700 having an alternative locking mechanism in accordance with the principles of the invention. Unlike the timepiece of FIGS. 1A and 1B, the upper and lower chambers 710, 730 are connected using a plurality of screws 718 that pass through apertures 722 in the lower chamber 730 and into threaded engagement with apertures 726 in screw bases 732 of the upper chamber 710. These screw bases 732 are projections of the upper chamber 710 that fit within corresponding recesses 742 in the lower chamber 730. Similar to the timepiece of FIGS. 1A and 1B, the lower chamber 730 includes a front face 720, a hollow portion 725 for the knot of the looped string, and a centrally disposed aperture 738 for the passage of the looped string. Although the illustrated embodiment include four screws 718, it is hereby noted that any number of screws, or other means of attachment, may be employed without departing from the scope of the invention.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. These illustrations and their accompanying description should not be construed as mandating a particular architecture or configuration.

The invention claimed is:

1. An attachable timepiece, comprising:

an upper chamber forming a housing for timepiece elements, the upper chamber including a front face having a time display;

a lower chamber that is detachable from the upper chamber by way of a locking system; and a looped string attached to the lower chamber, wherein the looped string attaches the timepiece to a surfboard leash plug; wherein the upper and lower chambers form a waterproof structure;

and wherein the looped string is attached to the lower chamber in a location opposite to the time display of the upper chamber.

2. The timepiece of claim 1, wherein the lower chamber is hollow and includes a centrally disposed aperture for the passage of the looped string, thereby connecting the looped string to the lower chamber.

3. The timepiece of claim 1, wherein the front face is substantially flat and wherein the time display comprises a digital time display.

4. The timepiece of claim 1, wherein the locking system comprises a threaded section disposed on an outside portion of the upper chamber that is configured to mate with a corresponding threaded section disposed on an inside portion of the lower chamber.

5. The timepiece of claim 4, wherein the upper chamber is detached from the lower chamber by unscrewing the upper chamber from the lower chamber.

6. The timepiece of claim 1, wherein the looped string is threaded through the surfboard leash plug and pulled until the lower chamber is forced against the plug.

7. The timepiece of claim 6, wherein the lower chamber engages the surfboard leash plug such that the front face remains visible to the user.

8. The timepiece of claim 7, wherein the looped string provides a means for user to attach a surfboard leash.

9. An attachable timepiece, comprising:

an upper chamber forming a housing for timepiece elements, the upper chamber including a front face having a digital time display and a threaded section;

a lower chamber having a threaded section corresponding to the threaded section of the upper chamber such that the chambers are configured to be screwed together; and a looped string that is attached to the lower chamber, wherein the looped string attaches the timepiece to a surfboard leash plug; wherein the upper and lower chambers form a waterproof structure;

and wherein the looped string is attached to the lower chamber in a location opposite to the time display of the upper chamber.

10. The timepiece of claim 9, wherein the lower chamber is hollow and includes a centrally disposed aperture for the passage of the looped string, thereby connecting the looped string to the lower chamber.

11. The timepiece of claim 9, wherein the looped string is threaded through the surfboard leash plug and pulled until the lower chamber is forced against the plug.

12. The timepiece of claim 11, wherein the lower chamber is configured to engage the surfboard leash plug such that the front face remains visible to a user.

13. The timepiece of claim 9, further comprising at least one screw configured to pass through an aperture in the upper and lower chambers to provide a locking mechanism.

14. An attachable timepiece, comprising:

a one-piece casing forming a housing for timepiece elements and including a threaded recess;

a front face, including a time display, configured to be screwed into the threaded recess; and a looped string that is attached within the casing, wherein the looped string attaches the timepiece to a surfboard leash plug; wherein the one-piece casing and the front face form a waterproof structure; and wherein the looped string is attached to the one-piece casing opposite to the time display.

* * * * *